US008113891B1

(12) United States Patent
Huang et al.

(10) Patent No.: US 8,113,891 B1
(45) Date of Patent: Feb. 14, 2012

(54) CONNECTOR TERMINAL

(75) Inventors: Cheng-Qiang Huang, Taipei (TW); Bing-Tao Yang, Taipei (TW); Yin-Lung Wu, Taipei (TW); Ming-Chiang Chen, Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 12/904,140

(22) Filed: Oct. 13, 2010

(51) Int. Cl.
*H01R 4/48* (2006.01)

(52) U.S. Cl. ..... 439/862

(58) Field of Classification Search ..... 439/66, 439/78, 83, 630, 862
See application file for complete search history.

(56) References Cited

U.S. PATENT DOCUMENTS

| | | | | |
|---|---|---|---|---|
| 7,494,381 | B1 * | 2/2009 | Wu et al. | 439/630 |
| 7,686,644 | B2 * | 3/2010 | Chu et al. | 439/500 |
| 7,833,069 | B2 * | 11/2010 | Wu et al. | 439/862 |
| 8,007,327 | B2 * | 8/2011 | Yang et al. | 439/862 |
| 8,052,428 | B2 * | 11/2011 | Tsao | 439/66 |

* cited by examiner

*Primary Examiner* — Khiem Nguyen

(57) ABSTRACT

A connector terminal which is curved from a strip-shaped metal plate to form a substantial R-shape includes a soldering plate and a flexible arm gradually away from the soldering plate from one end of the flexible arm to the other end of the flexible arm and arching toward the soldering plate. One end of the flexible arm abuts against the soldering plate and the other end of the flexible arm is bent towards the soldering plate to form a contacting end. An arched bent portion connects the soldering plate and one end of the flexible arm, which abuts against the soldering plate, to make the connector terminal show a substantial R-shape. When an external force acts on the contacting end to press the contacting end towards the soldering plate, the contact area between the flexible arm and the soldering plate is gradually enlarged.

3 Claims, 4 Drawing Sheets

CONNECTOR TERMINAL

BACKGROUND OF THE INVENTION

1. Field of the Invention

The present invention relates to a connector terminal, and particularly to a connector terminal curved from a strip-shaped metal plate.

2. The Related Art

Referring to FIG. 1 and FIG. 2, a conventional connector terminal 100' is of substantially lying-U shape and has a soldering plate 10'. One end of the soldering plate 10' is bent upwards to form a bent portion 20'. A free end of the bent portion 20' further extends towards a direction parallel to the soldering plate 10' to form a flexible arm 30' apart facing the soldering plate 10'. A free end of the flexible arm 10' is arched opposite to the soldering plate 10' to form a contacting end 40'.

However, when excessive press force acts on the contacting end 40' repeatedly, the bent portion 20' of the connector terminal 100' is apt to deform as the press force is mainly centralized on the bent portion 20'. As a result, the deformation of the bent portion 20' would cause the connector terminal 100' fail to connect with an external connecting module stably.

SUMMARY OF THE INVENTION

Accordingly, an object of the present invention is to provide a connector terminal. The connector terminal which is curved from a strip-shaped metal plate to form a substantial R-shape includes a soldering plate and a flexible arm gradually away from the soldering plate from one end of the flexible arm to the other end of the flexible arm and arching toward the soldering plate. One end of the flexible arm abuts against the soldering plate and the other end of the flexible arm is bent towards the soldering plate to form a contacting end. An arched bent portion connects the soldering plate and one end of the flexible arm, which abuts against the soldering plate, to make the connector terminal show a substantial R-shape. When an external force acts on the contacting end to press the contacting end towards the soldering plate, the contact area between the flexible arm and the soldering plate is gradually enlarged.

As described above, because the connector terminal is of substantial R-shape, when the external force acts on the contacting end, such structure can make the force be distributed over the flexible arm to overcome the defect of the press force being excessively centralized on the bent portion in the prior art. So it effectively avoids the deformation of the bent portion. Furthermore, such structure of the connector terminal can provide enough bounce forces to make the connector terminal returned to the initial state very well.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
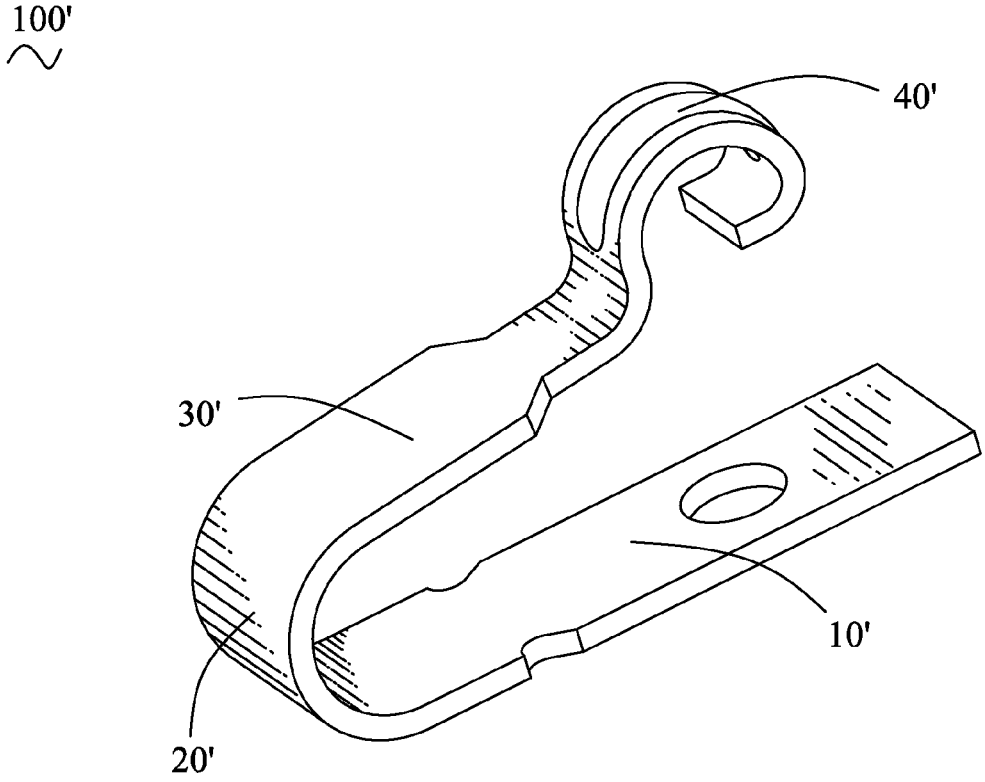
FIG. 1 (Prior Art)
FIG. 1 is a perspective view of a connector terminal in accordance with the prior art.
Figure 2:
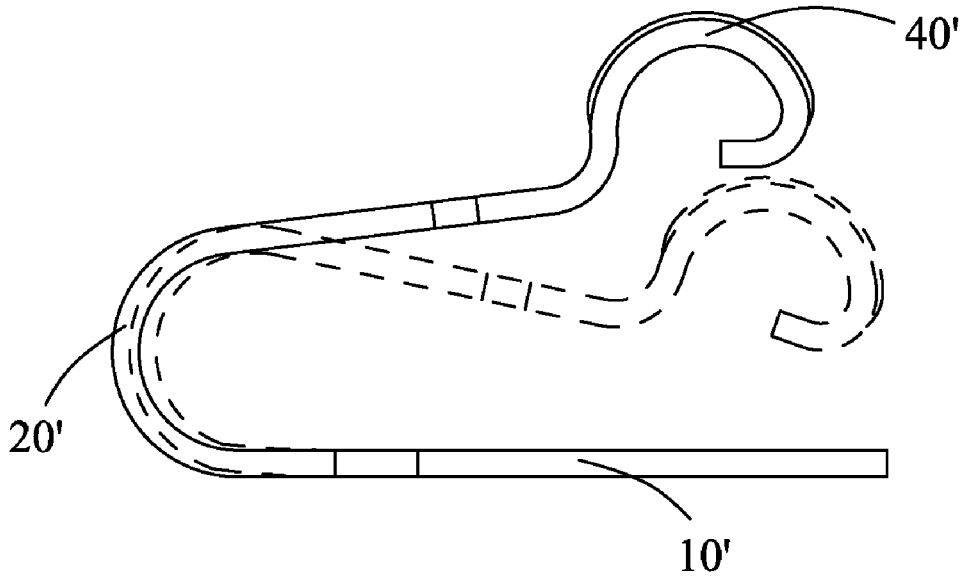
FIG. 2 (Prior Art)
FIG. 2 is a lateral view showing that the connector terminal of FIG. 1 is off working state and in working state.
Figure 3:
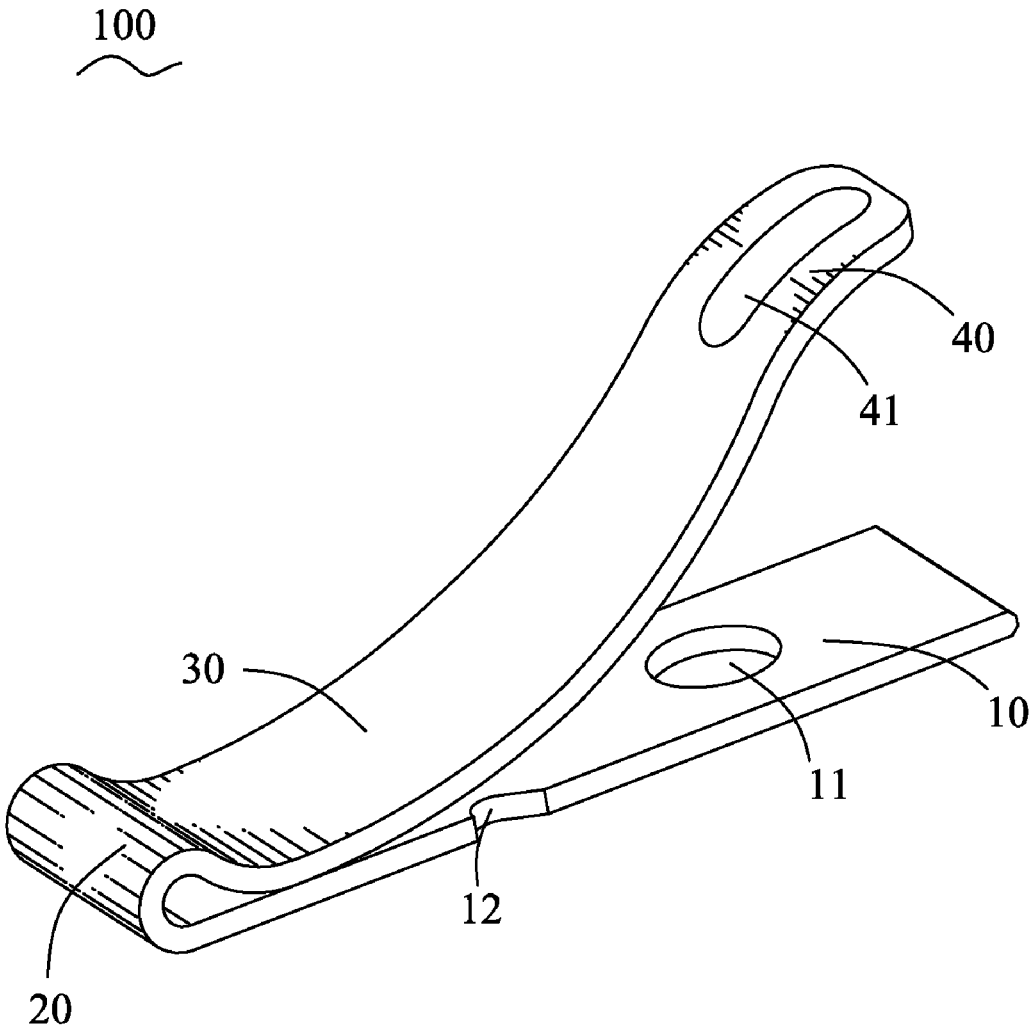
FIG. 3 is a perspective view of a connector terminal of an embodiment in accordance with the present invention.
Figure 4:
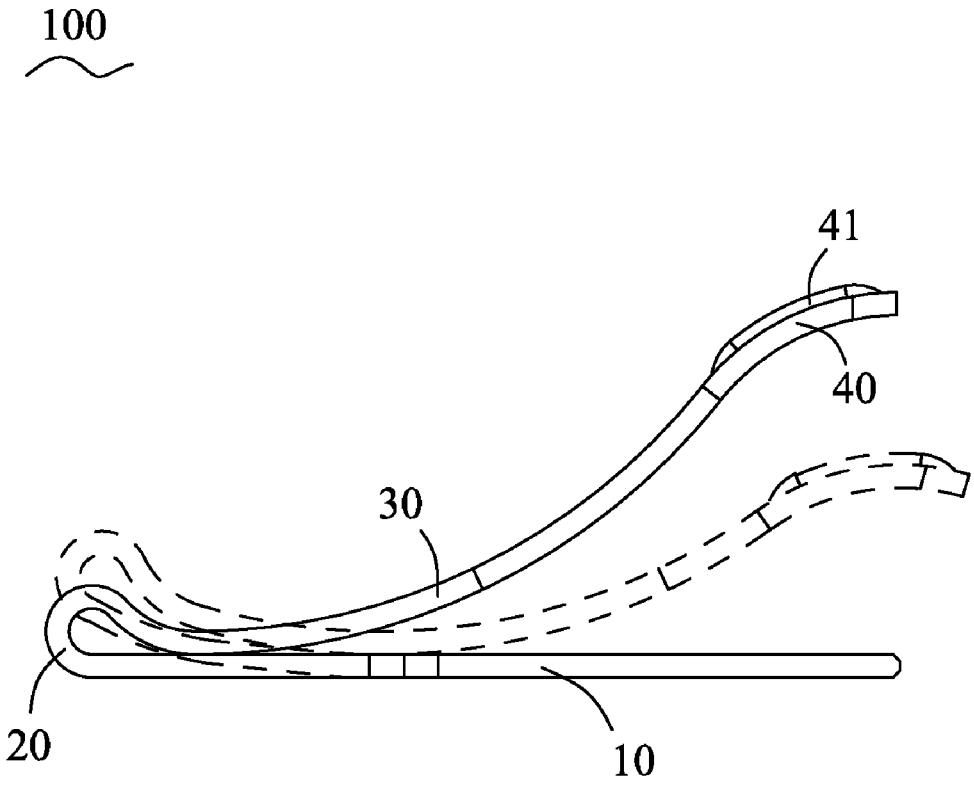
FIG. 4 is a lateral view showing that the connector terminal of FIG. 3 is off working state and in working state.

Referring to the drawings in greater detail, and first to FIG. 3 and FIG. 4, the embodiment of the invention is embodied in a connector terminal 100. The connector terminal 100 is curved from a strip-shaped metal plate to form a substantial R-shape, and has a strip-shaped soldering plate 10, a flexible arm 30 and an arched bent portion 20 which connects the soldering plate 10 and the flexible arm 30. The flexible arm 30 is gradually away from the soldering plate 10 from one end thereof to the other end thereof and arches towards the soldering plate 10 to show an arc shape along the extension direction thereof, with one end which is connected with the bent portion 20 abutting against the soldering plate 10, the other end of the flexible arm 30 being slightly bent towards the soldering plate 10 to form a contacting end 40. A contacting rib 41 is provided at a surface of the contacting end 40 opposite to the soldering plate 10 and further extends to traverse the junction of the contacting end 40 and the flexible arm 30, for contacting a corresponding connecting module (not shown).

Referring to FIG. 3 again, a hole 11 is opened at one end of the soldering plate 10 and apart from the bent portion 20. A substantial middle portion of each side edge of the soldering plate 10 defines a gap 12.

Referring to FIG. 4 again, an electrical connector (not shown) with the connector terminal 100 fixed therein is mounted on a printed circuit board (not shown) by means of soldering the soldering plate 10 to the printed circuit board. Because of the structures of the hole 11 and the gaps 12 opened in the soldering plate 10, excessive melting solder will be accumulated in the hole 11 and the gaps 12 to avoid the excessive melting solder spreading to the bent portion 20 and the flexible arm 30, when the soldering plate 10 is soldered on the printed circuit board. When there is no external force acting on the contacting end 40, one end of the flexible arm 30 connected with the bent portion 20 abuts against the soldering plate 10. When an external force acts on the contacting rib 41 of the contacting end 40 to press the contacting end 40 towards the soldering plate 10, the contacting area between the flexible arm 30 and the soldering plate 10 is gradually enlarged with the degree of the flexible arm 30 leaning towards the soldering plate 10, so as to make the force be distributed over the flexible arm 30. Meanwhile, in the process of the flexible arm 30 leaning towards the soldering plate 10, the flexible arm 30 further drives the soldering plate 10 to be curved upward via the traction force thereof so as to make the force acting on the contacting end 40 be further shared by the soldering plate 10. It effectively avoids the deformation of the bent portion 20 after overcoming the defect of the press force being excessively centralized on the bent portion 20' in the prior art. Furthermore, such structure of the connector terminal 100 can provide enough bounce forces to make the connector terminal 100 returned to an initial state very well.

As described above, because the connector terminal 100 is of substantial R-shape, when the connecting module contacts the contacting rib 41 of the contacting end 40, such structure can make the force acting on the connector terminal 100 be distributed by the flexible arm 30 and the soldering plate 10 to overcome the defect of the press force being excessively centralized on the bent portion 20' in the prior art. So it effectively avoids the deformation of the bent portion 20. Furthermore, such structure of the connector terminal 100 can provide enough bounce forces to make the connector terminal 100 returned to the initial state very well.

The foregoing description of the present invention has been presented for the purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A connector terminal, which is curved from a strip-shaped metal plate to form a substantial R-shape, comprising:

a soldering plate;

a flexible arm, with one end thereof abutting against the soldering plate, the flexible arm being gradually away from the soldering plate from one end thereof to the other end thereof and arching toward the soldering plate, the other end of the flexible arm being bent towards the soldering plate to form a contacting end; and an arched bent portion connecting the soldering plate and one end of the flexible arm, which abuts against the soldering plate, to make the connector terminal show substantial R-shape, when an external force acts on the contacting end to press the contacting end towards the soldering plate, the contact area between the flexible arm and the soldering plate is gradually enlarged.

2. The connector terminal as claimed in claim 1, wherein the flexible arm can further drive the soldering plate to be curved via the traction force thereof so as to make the force acting on the contacting end be further shared by the flexible arm and the soldering plate.

3. The connector terminal as claimed in claim 1, wherein a contacting rib is provided at a surface of the contacting end opposite to the soldering plate and further extends to traverse the junction of the contacting end and the flexible arm.

* * * * *